US009277625B2

(12) United States Patent
Wang et al.

(10) Patent No.: US 9,277,625 B2
(45) Date of Patent: Mar. 1, 2016

(54) DIMMING SYSTEM AND DIMMING CONVERTER AND LOAD DIMMING METHOD THEREOF

(71) Applicant: Schneider Electric (Australia) Pty Ltd., Macquarie Park (AU)

(72) Inventors: Weiguo Wang, Shenzhen (CN); Yulin Liu, Shenzhen (CN); Lei Shi, Shenzhen (CN)

(73) Assignee: SCHNEIDER ELECTRIC (AUSTRALIA) PTY LTD, Macquarie (AU)

( * ) Notice: Subject to any disclaimer, the term of this patent is extended or adjusted under 35 U.S.C. 154(b) by 267 days.

(21) Appl. No.: 14/140,719

(22) Filed: Dec. 26, 2013

(65) Prior Publication Data

US 2014/0184104 A1 Jul. 3, 2014

(30) Foreign Application Priority Data

Dec. 28, 2012 (CN) ..... 2012 1 0587338

(51) Int. Cl.

*G05F 1/00* (2006.01)
*H05B 37/02* (2006.01)
*H05B 39/08* (2006.01)

(52) U.S. Cl.

CPC ..... *H05B 37/02* (2013.01); *H05B 39/08* (2013.01)

(58) Field of Classification Search

CPC ..... H05B 37/02
USPC ..... 315/307, 291, 294, 297, 209 R
See application file for complete search history.

(56) References Cited

U.S. PATENT DOCUMENTS 7,667,408 B2 * 2/2010 Melanson ..... H05B 33/0809 315/209 R
2008/0180036 A1 7/2008 Garrity et al.

(Continued)

FOREIGN PATENT DOCUMENTS

KR 10-2011-0126626 11/2011
KR 10-2012-0113752 10/2012

(Continued)

OTHER PUBLICATIONS

Korean Office Action dated Jun. 10, 2015, for Korean Application No. 10-2013-0165872 (with English translation).

(Continued)

*Primary Examiner* — Lincoln Donovan
*Assistant Examiner* — Thomas Skibinski
(74) *Attorney, Agent, or Firm* — Patterson & Sheridan LLP

(57) ABSTRACT

A dimming system and a dimming converter and load dimming method thereof are provided. In the dimming converter, a cutting phase determination unit is connected with an input terminal and configured to determine phase angle information of a power supply signal of an output of a load terminal in a dimmer; an output unit is configured to output a dimming signal corresponding to the phase angle information determined by the cutting phase determination unit from a dimming output terminal to a load of the dimming system according to a correspondence relationship between the phase angle information and the dimming signal stored in a storage unit and to output a phase-cut power source signal from a supply output terminal to the load. The dimming system can be compatible with a large number of loads with different dimming requirements to thereby improve the dimming efficiency of the loads.

10 Claims, 4 Drawing Sheets

(56) References Cited

U.S. PATENT DOCUMENTS

| | | | | |
|---|---|---|---|---|
| 2008/0284350 | A1 | 11/2008 | Xu et al. | |
| 2009/0243582 | A1* | 10/2009 | Irissou | H05B 39/08 323/320 |
| 2010/0181930 | A1 | 7/2010 | Hopwood et al. | |
| 2011/0012528 | A1 | 1/2011 | Tsui et al. | |
| 2012/0235594 | A1* | 9/2012 | Hontele | H05B 33/0815 315/291 |

FOREIGN PATENT DOCUMENTS

| | | | |
|---|---|---|---|
| WO | 2009120555 | A1 | 10/2009 |
| WO | 2011070480 | A1 | 6/2011 |

OTHER PUBLICATIONS

EPO Search Report for European Application No. 13199679.5, dated Mar. 27, 2014.

* cited by examiner

DIMMING SYSTEM AND DIMMING CONVERTER AND LOAD DIMMING METHOD THEREOF

FIELD OF THE INVENTION

The present invention relates to the field of electronic device technologies and in particular to a dimming system and a dimming converter and load dimming method thereof.

BACKGROUND OF THE INVENTION

A phase-cut dimmer is included in an existing dimming system to phase-cut and then supply mains power to a load so that the load can be dimmed by the phase-cut dimmer phase-cutting the mains power. However dimming requirements are different and even significantly different among loads, e.g., lighting loads such as fluorescent lamp, so that a phase-cut power supply to the loads with different dimming requirements to dim the loads in the prior art may come with underutilization of the phase-cut power supply or insufficiency of the phase-cut power supply to dim the loads, and switching may render the loads dimmed inefficiently to thereby degrade the service life of the loads.

SUMMARY OF THE INVENTION

According to an embodiment of the invention, there is provided a dimming system and a dimming converter and load dimming method thereof, which are compatible with loads having different dimming requirements and can improve the dimming efficiency of the loads.

An embodiment of the invention provides a dimming converter of a dimming system, including an input terminal connected with an output of a load terminal in a dimmer, a cutting phase determination unit, an output unit, a storage unit, a supply output terminal and a dimming output terminal, wherein:

the cutting phase determination unit is connected with the input terminal and configured to determine phase angle information of a power supply signal of the output of the load terminal in the dimmer; and the output unit is connected with respectively with the supply output terminal and the dimming output terminal, and the output unit is further connected with the storage unit and configured to output a dimming signal corresponding to the phase angle information determined by the cutting phase determination unit from the dimming output terminal to a load of the dimming system according to a correspondence relationship between the phase angle information and the dimming signal stored in the storage unit and to output the power source signal from the supply output terminal to the load.

According to an embodiment of the invention, there is provided a dimming system including a dimmer, a dimming converter and a load; and A load terminal of the dimmer is connected with an input terminal of the dimming converter, and a supply output terminal and a dimming output terminal of the dimming converter are connected respectively with a supply terminal and a dimming interface of the load.

The dimming converter includes the input terminal connected with an output of the load terminal in the dimmer, a cutting phase determination unit, an output unit, a storage unit, the supply output terminal and the dimming output terminal, wherein:

the cutting phase determination unit is connected with the input terminal and configured to determine phase angle information of a power supply signal of the output of the load terminal in the dimmer; and the output unit is connected with respectively with the supply output terminal and the dimming output terminal, and the output unit is further connected with the storage unit and configured to output a dimming signal corresponding to the phase angle information determined by the cutting phase determination unit from the dimming output terminal to the load of the dimming system according to a correspondence relationship between the phase angle information and the dimming signal stored in the storage unit and to output the power source signal from the supply output terminal to the load.

According to an embodiment of the invention, there is provided a load dimming method of a dimming system, the method including the steps of:

determining phase angle information of a power supply signal output from a dimmer in a dimming system; and sending a dimming signal corresponding to the determined phase angle information to a dimming interface of a load of the dimming system according to a preset correspondence relationship between the phase angle information and the dimming signal and sending the power supply signal to a power supply terminal of the load.

The dimming converter according to the embodiment of the invention includes the input terminal connected with the output of the load terminal in the dimmer, the cutting phase determination unit, the output unit, the storage unit, the supply output terminal and the dimming output terminal, where the cutting phase determination unit is connected with the input terminal and configured to determine the phase angle information of the power supply signal of the output of the load terminal in the dimmer; the output unit is connected with respectively with the supply output terminal and the dimming output terminal, and the output unit is further connected with the storage unit and configured to output the dimming signal corresponding to the phase angle information determined by the cutting phase determination unit from the dimming output terminal to the load of the dimming system according to the correspondence relationship between the phase angle information and the dimming signal stored in the storage unit and to output the phase-cut power source signal from the supply output terminal to the load. Thus the dimming converter outputs the dimming signal with a different value to the load according to a particular condition of phase-cutting of the mains power by the dimmer, i.e., the phase angle information of the phase-cut power supply signal, instead of outputting the phase-cut power supply signal directly to provide the load with a light flux required for dimming, so that the dimming system can be compatible with a large number of loads which have different dimming requirements to thereby improve the dimming efficiency of the loads.

BRIEF DESCRIPTION OF THE DRAWINGS

In order to describe more clearly the technical solutions in the embodiments of the invention or in the prior art, the drawings to be used in the description of the embodiments or the prior art will be described briefly, and obviously the drawings in the following description are illustrative of only some embodiments of the invention, and those ordinarily skilled in the art can derive from these drawings other drawings without any inventive effort. In the drawings.

DETAILED DESCRIPTION OF THE INVENTION

The technical solutions in the embodiments of the invention will be described below clearly and fully with reference to the drawings in the embodiments of the invention, and apparently the described embodiments are only a part but not all of the embodiments of the invention. Based upon the embodiments of the invention, all the other embodiments derived by those ordinarily skilled in the art without any inventive effort shall come into the scope of the invention.

Figure 1:
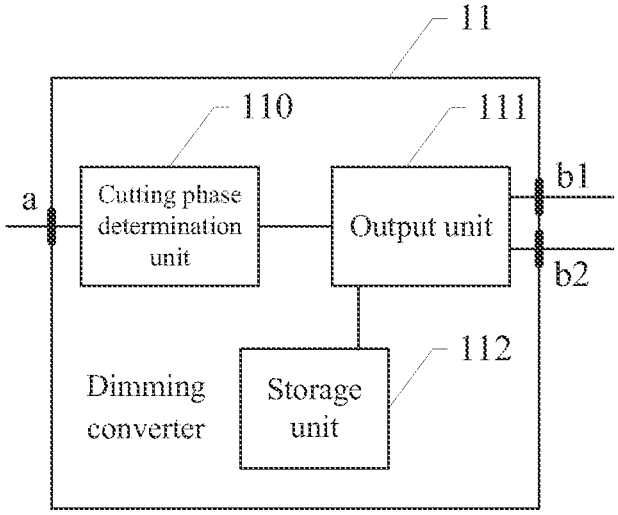
FIG. 1 is a schematic structural diagram of a dimming converter of a dimming system according to an embodiment of the invention.

FIG. 1 illustrates a schematic structural diagram of a dimming converter 11 of a dimming system according to an embodiment of the invention, where the dimming converter 11 includes an input terminal a connected with an output of a load terminal in a dimmer, a cutting phase determination unit 110, an output unit 111, a storage unit 112, a supply output terminal b1 and a dimming output terminal b2, where:

The cutting phase determination unit 110 is connected with the input terminal a and configured to determine phase angle information of a power supply signal of the output of the load terminal in the dimmer, where the dimmer can be a leading edge cutting dimmer, i.e., a dimmer capable of chopping a first half of each cycle in the power supply signal, or a trailing edge cutting dimmer, i.e., a dimmer capable of chopping a second half of each cycle in the power supply signal; and the load terminal of the dimmer refers to an output terminal at which the dimmer outputs the phase-cut mains power. Particularly according to a waveform of the power supply signal output from the dimmer, the cutting phase determination unit 110 can determine the phase angle information, e.g., a phase-cutting percentage, i.e., the percentage of a phase angle of the phase-cut power supply signal to a phase angle of the power supply signal before phase cutting, or determine information such as the value of the phase angle of the phase-cut power supply signal.

The output unit 111 is connected respectively with the supply output terminal b1 and the dimming output terminal b2, and the output unit 111 is further connected with the storage unit 112 and configured to output a dimming signal corresponding to the phase angle information determined by the cutting phase determination unit 110 from the dimming output terminal b2 to the load of the dimming system according to a correspondence relationship between the phase angle information and the dimming signal stored in the storage unit 12 so as to supply light flux required to dim the load, and the output unit 111 outputs the power supply signal output from the dimmer from the supply output terminal b1 to the load to supply a power supply required for normal operation of the load.

The storage unit 112 is configured to store the correspondence relationship between the phase angle information and the dimming signal, particularly including a functional correspondence relationship between the phase-cutting percentage and the dimming signal, the value of the phase-cutting percentage and the value of the dimming signal (particularly the amplitude of the dimming signal), etc. The correspondence relationship stored in the storage unit 112 can be preset by a user as needed in practice and particularly can be preset by the user according to a real requirement for the load in the dimming system, for example, if the load needs to be dimmed at a voltage ranging from 1V to 10V, then the user can preset the dimming signal in the correspondence relationship in the storage unit 112 to be 1V to 10V.

Figure 2A:
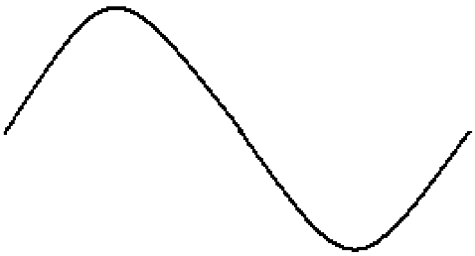
FIG. 2*a* is a waveform diagram of a power supply signal before a dimmer phase-cuts mains power.
Figure 2B:
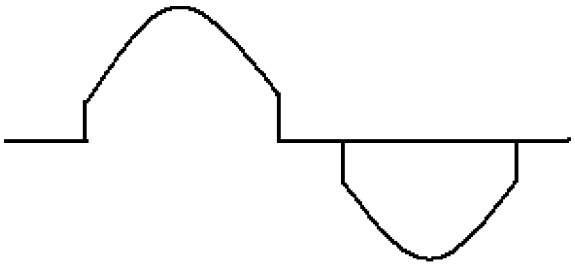
FIG. 2*b* is a waveform diagram of the power supply signal at a phase-cutting percentage of 80%.
Figure 2C:
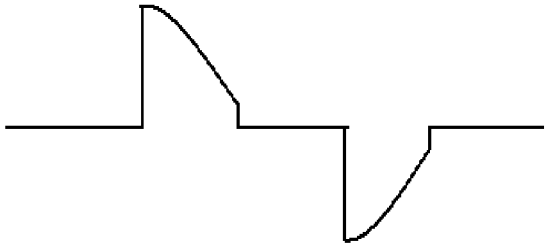
FIG. 2*c* is a waveform diagram of the power supply signal at a phase-cutting percentage of 50%.
Figure 2D:
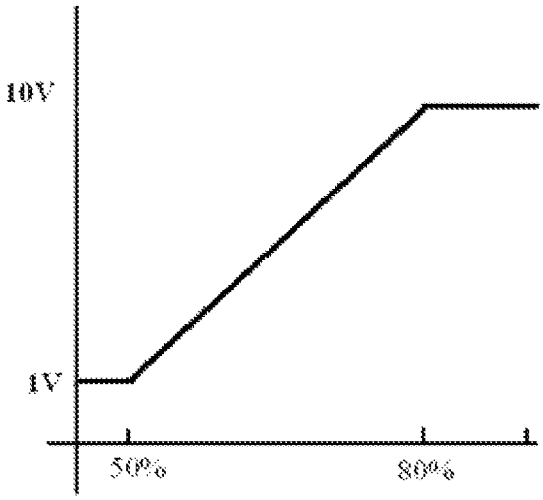
FIG. 2*d* is a diagram of a correspondence relationship between particular values of a phase-cutting percentage and a dimming signal.

Referring to FIG. 2*a* to 2*d*, FIG. 2*a* is a waveform diagram of the power supply signal before the dimmer phase-cuts the mains power, FIG. 2*b* is a waveform diagram of the power supply signal at a phase-cutting percentage of 80%, FIG. 2*c* is a waveform diagram of the power supply signal at a phase-cutting percentage of 50%, and FIG. 2*d* is a diagram of a correspondence relationship between particular values of the phase-cutting percentage and the dimming signal, and then the following correspondence relationship can be stored in the storage unit 112: the value of the dimming signal is the lowest nominal value such as 1 volt (V), for example, at a phase-cutting percentage of 50%, and in this case, the output unit 111 outputs a low light flux required for dimming from the dimming output terminal b2 to the load, and the load can be dimmed to the darkest; the value of the dimming signal is the highest nominal value such as 10 V, for example, at a phase-cutting percentage of 80%, and in this case, the output unit 111 outputs a high light flux required for dimming from the dimming output terminal b2 to the load, and the load can be dimmed to the brightest; and the value of the dimming signal varies in proportion to the phase-cutting percentage ranging between 50% and 80%, and in a particular embodiment, the value of the dimming signal can alternatively vary in another functional relationship in correspondence to the phase-cutting percentage, e.g., an exponential functional relationship, a logarithmic functional relationship, etc.

As can be apparent, the dimming converter according to the embodiment of the invention includes the input terminal connected with the output of the load terminal in the dimmer, the cutting phase determination unit, the output unit, the storage unit, the supply output terminal and the dimming output terminal, where the cutting phase determination unit is connected with the input terminal and configured to determine the phase angle information of the power supply signal from the output of the load terminal in the dimmer; the output unit is connected respectively with the supply output terminal and the dimming output terminal, and the output unit is further connected with the storage unit and configured to output the dimming signal corresponding to the phase angle information determined by the cutting phase determination unit from the dimming output terminal to the load of the dimming system according to the correspondence relationship between the phase angle information and the dimming signal stored in the storage unit and to output the phase-cut power supply signal from the supply output terminal to the load. Thus the dimming converter outputs the dimming signal with a different value to the load according to a particular condition of phase-cutting of the mains power by the dimmer, i.e., the phase angle information of the phase-cut power supply signal, instead of directly outputting the phase-cut power supply signal to provide the load with a light flux required for dimming, so that the dimming system can be compatible with a large number of loads which have different dimming requirements to thereby improve the dimming efficiency of the loads.

Figure 3:
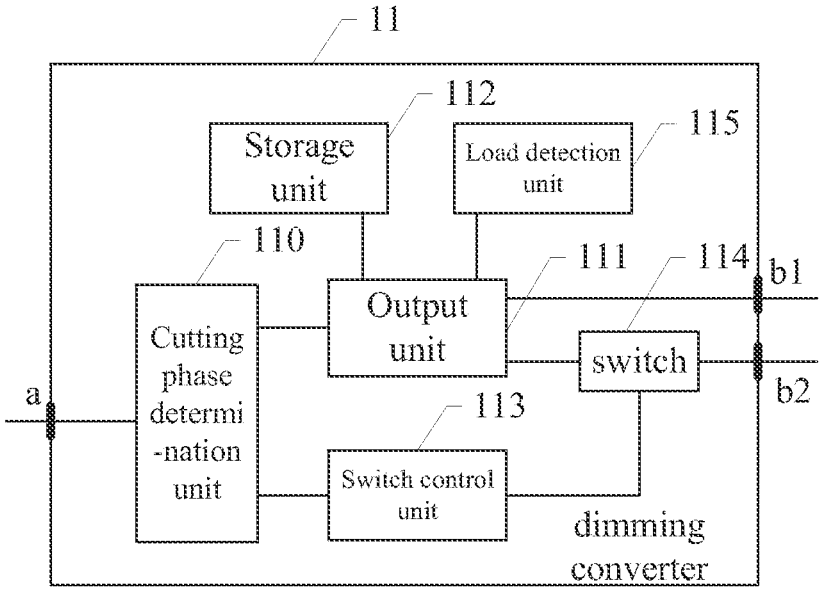
FIG. 3 is a schematic structural diagram of a dimming converter of another dimming system according to an embodiment of the invention.

Referring to FIG. 3, in a particular embodiment, the dimming converter 11 can include a switch control unit 113, a switch 114 and a load detection unit 115 in addition to the structure illustrated in FIG. 1, where:

The switch 114 is connected between the output unit 111 and the dimming output terminal b2, and the switch control unit 113 is connected with a control terminal of the switch 114 and configured to control the switch 114 to be opened when the value of the phase-cutting percentage or the phase angle in the phase angle information determined by the cutting phase determining unit 110 is below a preset lowest value (e.g., the lowest cutting phase angle of 50%). Thus if the output unit 111 outputs a low light flux required for dimming from the dimming output terminal b2 to the load, then the load can be dimmed to the darkest, and at this time, in order to save power consumption, the dimming signal can be disconnected via the switch 114, and only normal mains power is output from the supply output terminal b1 to the load to maintain normal operation of the front-end dimmer; and the load can be prevented from flickering due to excessive phase-cutting of the mains power by the dimmer.

As can be appreciated, when the value of the phase-cutting percentage or the phase angle in the phase angle information determined by the cutting phase determining unit 110 is above or at the preset lowest value, the switch control unit 113 can control the switch 114 to be closed to output the dimming signal to the load.

The load detection unit 115 is configured to detect the type of the load in the dimming system, for example, the load is a capacitive load, an inductive load, a resistive load, etc, and particularly the load detection unit 115 can retrieve a waveform diagram of current or voltage in the circuitry of the dimming system and determine the type of the load uniquely according to characteristics of the waveform diagrams exhibited by the respective load.

Thus in the dimming converter 11 of this embodiment, correspondence relationships between the phase angle information and the dimming signal corresponding to the respective types of loads can be further stored in the storage unit 112, so that after the load detection unit 115 detects the type of the load, the output unit 111 can retrieve the correspondence relationship between the phase angle information and the dimming signal corresponding to the type of the load from the storage unit 112 and output the dimming signal corresponding to the phase angle information determined by the cutting phase determination unit 110 from the dimming output terminal b2 to the load of the dimming system according to the type of the load detected by the load detection unit 115 and the retrieved correspondence relationship.

For a type of load, for example, the value of the dimming signal varies from 1 V to 10 V with the phase-cutting percentage varying between 40% to 90% according to one functional relationship; and for another type of load, for example, the value of the dimming signal varies from 1 V to 10 V with the phase-cutting percentage varying between 70% to 80% according to another functional relationship. Particularly there is a wider range of the phase-cutting percentage corresponding to the inductive load than that of the phase-cutting percentage corresponding to the capacitive load.

Figure 4:
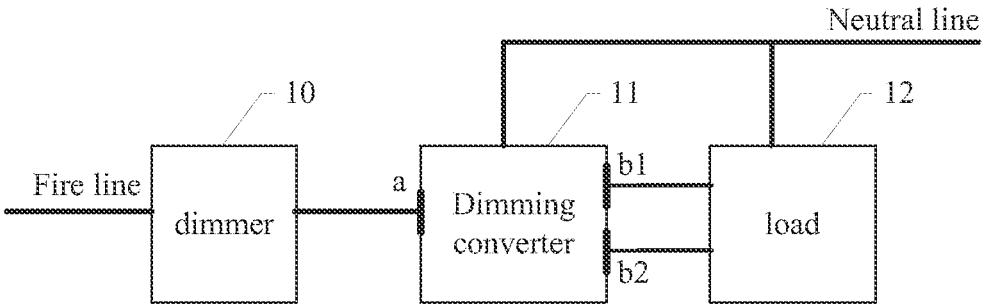
FIG. 4 is a schematic structural diagram of a dimming system according to an embodiment of the invention.

FIG. 4 is a schematic structural diagram of a dimming system according to an embodiment of the invention, where the dimming system includes a dimmer 10, a dimming converter 11 and a load 12, where:

A load terminal of the dimmer 10 is connected with an input terminal a of the dimming converter 11, and a supply output terminal b1 and a dimming output terminal b2 of the dimming converter 11 are connected respectively with a supply terminal and a dimming interface of the load, so that the dimming converter 11 outputs a power supply signal phase-cut by the dimmer 10 from the supply output terminal b1 to the load 12 to provide the load 12 with a power supply required for normal operation; and outputs a dimming signal to the load 12 from the dimming output terminal b2 to provide the load 12 with a light flux required for dimming. The structure of the dimming converter 11 can be as illustrated in FIG. 1 or FIG. 3 above, and a repeated description thereof will be omitted here.

The load 12 can be any lighting load, e.g., a lighting blast or driver in a switched power supply topology, a fluorescent lamp, an incandescent lamp, an energy saving lamp, a haloid lamp, etc., and may be a dimmable load, or a non-dimmable load; and the dimming interface of the load can be a DMX512 interface, a DALI interface, a 1V-10V standard interface, a 0V-10V standard interface or another dimmable interface.

In a practical application, a fire line, a neutral line and a ground line are typically present in a mains system powering the dimming system, and the mains power can be alternating current at 90 to 264V, where the neutral line and the ground line are equal in voltage, and the input terminal of the dimmer 10 in the dimming system needs to be connected with the fire line, so that the current passes and then goes from the load terminal of the dimmer 10 to the dimming converter 11 and next returns from the neutral line through the dimming converter 11 and the load 12.

Figure 5:
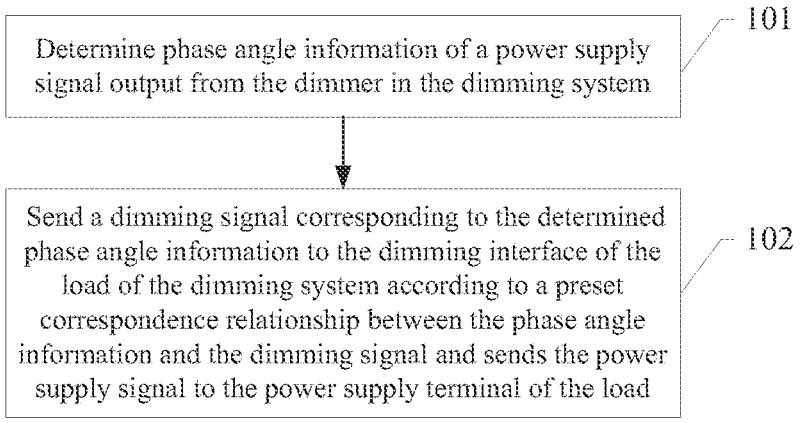
FIG. 5 is a flow chart of a load dimming method of a dimming system according to an embodiment of the invention.

An embodiment of the invention provides a load dimming method of a dimming system, applicable to the dimming system as illustrated in FIG. 4, and the method of this embodiment is a method performed by the dimming converter 11 as illustrated in FIG. 1 or 2 in the dimming system, a flow chart of which is as illustrated in FIG. 5, where the method includes:

Step 101, in which the dimming converter 11 determines phase angle information of a power supply signal output from the dimmer 10 in the dimming system, e.g., the value of a phase-cutting percentage, a phase angle, etc.

Step 102, in which the dimming converter 11 sends a dimming signal corresponding to the phase angle information determined in step 101 to the dimming interface of the load 12 of the dimming system according to a preset correspondence relationship between the phase angle information and the dimming signal so as to output a light flux required for dimming to the load 12 and sends the power supply signal phase-cut by the dimmer 10 to the power supply terminal of the load 12 for powering.

The preset correspondence relationship can include the value of the phase-cutting percentage and the value of the dimming signal, a functional correspondence relationship between the phase-cutting percentage and the dimming signal (e.g., a linear or exponential or logarithmic relationship), etc.

As can be apparent, with the method performed in steps 101 and 102, the dimming converter outputs the dimming signal with a different value to the load according to a particular condition of phase-cutting of mains power by the dimmer, i.e., the phase angle information of the phase-cut power supply signal, instead of outputting the phase-cut power supply signal directly to provide the load with a light flux required for dimming, so that the dimming system can be compatible with a large number of loads which have different dimming requirements to thereby improve the dimming efficiency of the loads.

Figure 6:
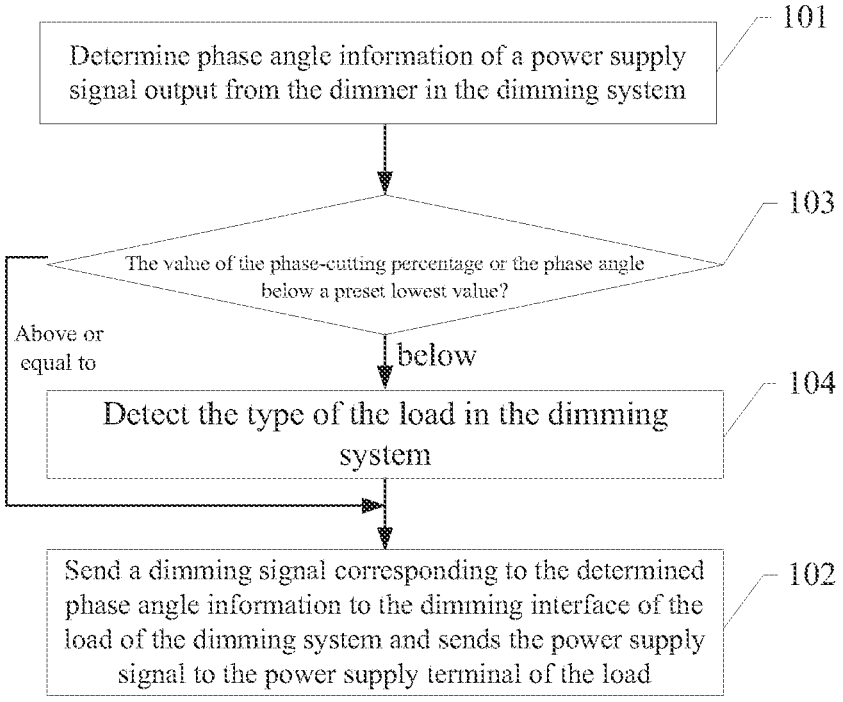
FIG. 6 is a flow chart of a load dimming method of another dimming system according to an embodiment of the invention.

Referring to FIG. 6, in a particular embodiment, the dimming converter 11 can further include steps 103 and 104 subsequent to step 101, and particularly:

In step 103, the dimming converter 11 judges whether the value of the phase-cutting percentage or the phase angle in the phase angle information determined in step 101 is below a preset lowest value, and if so, then it sends no dimming signal to the dimming interface of the load 12 but only sends the phase-cut power supply signal to the supply terminal of the load 12 and performs step 104, so that the dimmer can be prevented from flickering due to excessive phase cutting of the mains power by the dimmer, and the dimming interface of the load 12 can be stopped from being powered to save power consumption; and if the value is above or equal to the preset lowest value, then it performs step 102.

In step 104, the dimming converter 11 detects the type of the load 12 in the dimming system, e.g. an inductive load, a capacitive load, a resistive load, etc., and thereafter in step 102, the dimming converter 11 can locate a correspondence relationship between phase angle information and a dimming signal corresponding to the type of the load detected in the step 104 and then send the dimming signal corresponding to the phase angle information determined in step 101 in the located correspondence relationship to the dimming interface of the load 12 of the dimming system.

It shall be noted that step 104 may not necessarily be performed in an absolute sequential relationship with steps 101 and 102 but they can be performed concurrently or sequentially, and FIG. 6 illustrates only a particular implementation thereof; and in some particular embodiments, step 104 may not be necessary, and the type of the load 12 does not need to be detected, but the dimming converter 11 can be set by a user as needed in practice, to determine which load type's corresponding correspondence relationship is adopted by the dimming converter 11 to output the dimming signal.

Those ordinarily skilled in the art can appreciate that all or a part of the steps in the respective methods in the foregoing embodiments can be performed by program instructing relevant hardware, where the program can be stored in a computer readable storage medium including a Read Only Memory (ROM), a Random Access Memory (RAM), a magnetic disk, an optical disk, etc.

The dimming system and the dimming converter and load dimming method thereof according to the embodiments of the invention have been described above in details, and the principle and the embodiments of the invention have been set forth in this context by way of particular examples, but the foregoing description of the invention is merely intended to facilitate understanding of the inventive method and the essence thereof; and also those ordinarily skilled in the art can modify the particular embodiments and it's application scope in light of the idea of the invention. In summary the disclosure of the specification shall not be construed as limiting the scope of the invention.

The invention claimed is:

1. A dimming converter of a dimming system, comprising an input terminal connected with an output of a load terminal in a dimmer, a cutting phase determination unit, an output unit, a storage unit, a supply output terminal and a dimming output terminal, wherein:

the cutting phase determination unit is connected with the input terminal and configured to determine phase angle information of a power supply signal from the output of the load terminal in the dimmer; and the output unit is connected respectively with the supply output terminal and the dimming output terminal, and the output unit is further connected with the storage unit and configured to output a dimming signal corresponding to the phase angle information determined by the cutting phase determination unit from the dimming output terminal to a load of the dimming system according to a correspondence relationship between phase angle information and a dimming signal stored in the storage unit, and output a power supply signal from the supply output terminal to the load.

2. The dimming converter according to claim 1, wherein the dimming converter further includes a switch control unit and a switch, and the switch is connected between the output unit and the dimming output terminal; and the switch control unit is connected with a control terminal of the switch and configured to control the switch to be opened when a value of a phase-cutting percentage or a phase angle in the phase angle information determined by the cutting phase determining unit is below a preset lowest value.

3. The dimming converter according to claim 1, wherein the dimming converter further comprises a load detection unit, and the load detection unit is configured to detect the type of the load in the dimming system; and the output unit is configured to output the dimming signal corresponding to the phase angle information determined by the cutting phase determination unit from the dimming output terminal to the load of the dimming system according to the correspondence relationship between the phase angle information and the dimming signal, stored in the storage unit, corresponding to the type of the load.

4. A dimming system, comprising a dimmer, a dimming converter and a load, wherein the dimming converter is the dimming converter according to claim 1; and the load terminal of the dimmer is connected with the input terminal of the dimming converter, and the supply output terminal and the dimming output terminal of the dimming converter are connected respectively with a supply terminal and a dimming interface of the load.

5. A load dimming method of a dimming system, wherein the method comprises the steps of:

determining phase angle information of a power supply signal output from a dimmer in the dimming system; and sending a dimming signal corresponding to the determined phase angle information to a dimming interface of a load of the dimming system according to a preset correspondence relationship between phase angle information and a dimming signal and sending the power supply signal to a power supply terminal of the load.

6. The method according to claim 5, wherein after the determining the phase angle information of the power supply signal output from the dimmer in the dimming system, the method further comprises the steps of:

if a value of a phase-cutting percentage or a phase angle in the determined phase angle information is below a preset lowest value, then sending no dimming signal to the dimming interface of the load; and if a value of the phase-cutting percentage or the phase angle in the determined phase angle information is above or at the preset lowest value, then performing the step of sending the dimming signal to the dimming interface of the load of the dimming system.

7. The method according to claim 5, wherein before the sending the dimming signal corresponding to the determined phase angle information to the dimming interface of the load of the dimming system according to the preset correspondence relationship between the phase angle information and the dimming signal, the method further comprises the step of: detecting a type of the load in the dimming system; and the sending the dimming signal corresponding to the determined phase angle information to the dimming interface of the load of the dimming system according to the preset correspondence relationship between the phase angle information and the dimming signal comprises:

sending the dimming signal corresponding to the determined phase angle information to the dimming interface of the load of the dimming system according to the preset correspondence relationship, between the phase angle information and the dimming signal, corresponding to the type of the load.

8. The method according to claim 5, wherein the preset correspondence relationship between the phase angle information and the dimming signal comprises:

the value of the phase-cutting percentage and a value of the dimming signal, and a functional correspondence relationship between the phase-cutting percentage and the dimming signal.

9. The method of claim 5, embodied in a non-transitory program product storing machine readable instruction code, which when read and executed by a machine, the instruction code executes the load dimming method.

10. A non-transitory storage medium including a program, which when executed by a computer, causes the performance of the method of claim 5.

* * * * *